United States Patent [19]

Pelizzoni

[11] Patent Number: 4,465,040

[45] Date of Patent: Aug. 14, 1984

[54] VALVE GUIDE INSERT

[75] Inventor: Winton J. Pelizzoni, Allentown, Pa.

[73] Assignee: Mack Trucks, Inc., Allentown, Pa.

[21] Appl. No.: 213,321

[22] Filed: Dec. 5, 1980

[51] Int. Cl.[3] ..... F01L 3/08

[52] U.S. Cl. ..... 123/188 GC; 29/DIG. 39; 29/156.7 R

[58] Field of Search ..... 123/188 GC, 188 S; 29/156.7 R, 402.18, 525, DIG. 39

[56] References Cited

U.S. PATENT DOCUMENTS

| | | | |
|---|---|---|---|
| Re. 28,552 | 9/1975 | Smith | 420/436 |
| 1,947,493 | 2/1934 | Rose et al. | 29/DIG. 39 |
| 2,277,822 | 3/1942 | Essl | 123/188 GC |
| 2,303,145 | 11/1942 | Taylor | 123/188 GC |
| 2,314,902 | 3/1943 | Shepard | 29/DIG. 39 |
| 2,753,859 | 7/1956 | Bartlett | 123/188 S |
| 2,797,676 | 7/1957 | Van Skike | 123/188 GC |
| 3,037,494 | 6/1962 | Kirkpatrick et al. | 123/188 GC |
| 3,265,052 | 8/1966 | Goloff | 123/188 GC |
| 3,809,046 | 5/1974 | Kammeraad | 123/188 GC |
| 3,828,756 | 8/1974 | Kammeraad et al. | 123/188 GC |
| 3,885,546 | 5/1975 | Foley et al. | 123/188 P |
| 3,909,921 | 10/1975 | Brooks | 29/DIG. 39 |
| 4,103,662 | 8/1978 | Kammeraad | 123/188 GC |

FOREIGN PATENT DOCUMENTS

| | | | |
|---|---|---|---|
| 1236860 | 3/1967 | Fed. Rep. of Germany | 123/188 GC |

OTHER PUBLICATIONS

Wakefield, J. E., "How to Select Sprayed Metals", *American Machinist,* (Jul. 28, 1949), pp. 80–82.

*Primary Examiner*—Craig R. Feinberg
*Assistant Examiner*—W. R. Wolfe
*Attorney, Agent, or Firm*—Bernard, Rothwell & Brown

[57] ABSTRACT

A valve guide insert for placement in a valve guide of an internal combustion engine to guide a valve stem of the typical valve assembly while minimizing the valve insert wear. The valve guide insert may be a cast iron or other metal sleeve assembly having a port end and a spring end with a ring made of carbide, stellite, bonded metal or other wear-resistant material positioned inside the sleeve in the vicinity of the port end for engaging the valve stem during reciprocation. The ring can be a separate element retained within a recess of the sleeve, or a metal bonded onto a roughened portion of the sleeve and refinished to form a one-piece insert.

18 Claims, 8 Drawing Figures

VALVE GUIDE INSERT

BACKGROUND AND DISCUSSION OF THE INVENTION

In internal combustion engines, valves are employed at the entry and exit ports to the cylinders in which the pistons reciprocate and provide the driving force to the crankshaft of the engine. An overhead valve engine typically has what is referred to as a "head" which forms part of the combustion chamber of the cylinder in which the piston reciprocates. Within this head are the ports which are opened and closed by the valve assemblies, to permit introduction of fuel and/or air and the expulsion of exhaust gases. Typically the valve assembly includes a valve head which moves onto and off a valve seat defined by the engine head. Extending from the valve head is a valve stem which is spring-loaded, typically in the closed position, and actuated by a standard push rod and rocker arm assembly to overcome the bias of the spring and move the valve to an open position.

The valve stem is a relatively long, cylindrical portion of the valve extending from the middle of one side of the valve head, and the valve stem moves reciprocally, and with close tolerances, through a valve guide in the engine head assembly under the action of the push rod and rocker arm assembly. The valve guide may have an internal liner or insert through which the valve stem reciprocates. Over a period of time after repeated reciprocation in the valve guide or the liner the valve stem may be caused to rock a bit during reciprocation and eventually wear away a portion of the valve guide or liner surface. As a result of this wear the valve guide often has to be repaired or the liner replaced. If this is not done, the valve may not properly seat resulting in inefficiencies in engine operation. As the rocking action becomes more pronounced due to wear, the resulting poor seating and sealing contributes to higher oil consumption due to the increase in stem-guide clearance and increased blow-by the latter being particularly on the exhaust assembly and on the inlet assembly of turbo charged engines. In addition the stresses imposed on the valve by the rocking action resulting from valve guide or insert wear may eventually cause the valve stem or some other part of the valve assembly to break and damage other parts of the engine.

In repairing valve guides to avoid these problems, the guides have typically been bored out in the cylinder head and lined with cast iron or other metal inserts. Alternatively, the engine may be equipped with such inserts and when they are worn they can be replaced. In any event to retain these inserts in place, they have been force-fitted into the bored out valve guide passageway. Tolerances of these inserts with respect to the valve stem moving therein may, however, be difficult to achieve and their wear and lubrication characteristics could be improved. However, the inserts are generally made of metal having excellent heat transfer characteristics, e.g. cast iron, which is a major consideration in the operation of the valve, as well as its longevity.

There have been approaches made to improve valve guide wear, including the use of inserts employing a metallic inner sleeve having good wear characteristics in conjunction with an outer sleeve of another metal exhibiting the desired heat conductivity. For example, in U.S. Pat. No. 4,103,662 to Kammeraad, there is disclosed an outer sleeve to fit within the valve guide and the sleeve is comprised of steel or aluminum. An inner sleeve is force-fitted into the outer sleeve and engages the valve stem during its reciprocal motion. The inner sleeve is made of the phosphor-bronze and extends the full length of the outer sleeve. The outer sleeve is roll-formed, welded and redrawn to form a solid sleeve. The inner sleeve, however, is split, and the operator typically assembles the inner sleeve within the outer sleeve before placing the entire assembly into the valve guide. The split inner sleeve once placed within the outer sleeve will expand and be retained within the outer sleeve by frictional force. After assembly, the inner sleeve is grooved for oil retention. A driving tool is employed to drive the entire assembly within the valve guide passageway in the engine head.

The aforementioned procedure although it may have some features which favor its adoption in combatting valve guide wear problems is rather complex and employs relatively thin sleeves in a multifaceted assembly procedure to eventually position the separate items in place. In addition, the advantageous heat transfer characteristics of the valve guide are diminished due to the inner sleeve forming a barrier between the valve stem and the outer sleeve and valve guide passageway along essentially their entire length.

Another prior approach to valve guide construction has been the use of a steel insert coated with a layer of Teflon to provide lubrication. When the Teflon or other plastic coating material has been employed, it generally has been extended throughout the entire length of the internal surface of the valve guide assembly and again a substantial barrier to heat transfer is presented. Moreover, the plastic surface has relatively poor wear characteristics.

A feature of the present invention is the ability to concentrate a metal or other wear-resistant surface within the valve guide in the area of the most significant wear, while maintaining for the most part the heat transfer characteristics of the valve guide assembly. Frequently, the metals of good conductivity such as cast iron from which valve inserts have been made have poorer wear characteristics, while metallic surfaces that exhibit adequate resistance to wear have poorer heat transfer properties and may be more expensive. The present invention overcomes these problems by employing a valve guide insert that is made of high strength, good heat-conducting material and has a major portion of its internal surface exposed to the valve stem, while having only a minor portion of its internal surface occupied by a wear-resistant surface in the form of a ring, e.g. up to about 30% or more of the length of the insert. The percentage of wear-resistant material can vary depending on the engine and the stem to guide to port relationships, the valve lift, lubrication, among others. In any event, a more efficient system is obtained in overcoming wear without detracting from other advantages such as good dissipation of heat. Furthermore, the invention employs relatively few parts in a unique configuration such that the valve guide insert can be placed within the valve guide passageway with a minimum of effort avoiding the complexity of systems described above.

Some embodiments of the invention which incorporate the features just described include two and three-part valve guide assemblies in which a stellite or carbide or other wear-resistant ring is carried by sleeve or valve guide insert made for example, of cast iron. In one form, the invention includes two parts where the sleeve forms a major part of the assembly and has a spring end and another end remote therefrom for carrying the wear-resistant ring. The ring is configured to be retained in place by the sleeve and is arranged in the port end of the assembly. In another arrangement there are two sleeve parts which together completely circumscribe the ring which is thereby retained. In a third embodiment, the annular recess is carved in internal surfaces at or near the port end of a single sleeve member. The ring is placed in the recess and the ring has shoulders or other retention means for maintaining it in place.

In another form of applicant's invention a portion of the internal surfaces of the valve guide sleeve is machined or, otherwise, cut-away for bonding hard, wear-resistant metal as a ring inside the sleeve. Subsequently, the ring portion of the valve guide insert is bonded to the internal surfaces. When a sufficient depth of metal has been bonded to the sleeve, the internal surface of the entire composite can then be refinished to the desired size to achieve a constant internal diameter throughout. In this manner a one piece composite assembly is achieved with the wear-resistant ring being concentrated in the area of greatest potential wear at or near the port end of the sleeve. With this assembly, unlike the Teflon coating or internal sleeves which have provided lubrication or wear resistance throughout the entire length of valve guide inserts, the internal ring and its accompanying advantageous wear characteristics can be employed only in the vicinity of maximum wear adjacent the port end of the tube. Since only a relatively small part of the internal surface of the valve guide insert is covered, the remaining portion of the insert remains exposed to the valve stem so that the heat transfer characteristics of the insert remain substantially unhindered.

DETAILED DESCRIPTION OF THE PREFERRED EMBODIMENT

As can be seen in FIGS. 1, 2, 3 and 4 a valve guide insert assembly is provided in which the wear-resistant ring forms part of the internal surface of the guide in the vicinity of its port end. The ring can form an end of the sleeve or be configured to be fitted within the valve guide sleeve as an insert. The sleeve is typically made of cast iron or other metal having good lubrication and heat transfer characteristics.

Figure 1:
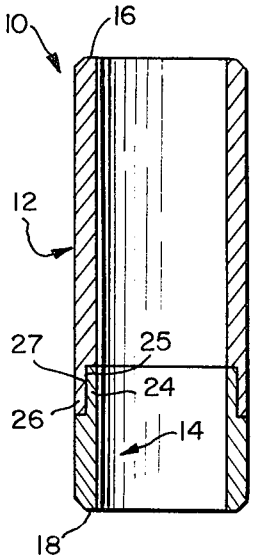
FIG. 1 shows a cross-section of a two-part valve guide sleeve of the invention in which a separately formed and inserted wear-resistant ring forms the port end of the assembly.

Referring to FIG. 1, the tubular valve guide insert assembly 10 includes a first part 12 which is a cylindrical cast iron sleeve. A stellite alloy or cemented heavy metal carbide ring 14 forms the second part of the assembly, although other good wearing materials may be employed, and is configured to be complementary to the end of the cast iron sleeve remote from the spring end 16. The cemented carbides are powder metallurgical products composed of a carbide of a heavy metal of Groups IVA to VIA in a matrix of a metal, often cobalt. The carbide may, for example, include tungsten carbide or titanium carbide. Ring 14 defines the port end 18 of the guide opposite spring end 16. Ring 14 has a complementary portion of its internal end for fitting within the complementary cast iron sleeve. More specifically, the end of sleeve 12 remote from spring end 16 has an internal recess 25 extending around the inside circumference of the sleeve. Recess 25 is formed in the end or external extension 26 of sleeve 12. Correspondingly, the end of ring 14 remote from the port end 18 includes an external recess 27 in which the external extension 26 of sleeve 12 can be received when the two parts are fitted together. In other words, the extension 26 telescopes over wall 24 of ring 14, each of members 24 and 26 can be press-fitted into the complementary recess formed in the other part of the valve guide insert as these members are press fitted into the valve guide.

Figure 2:
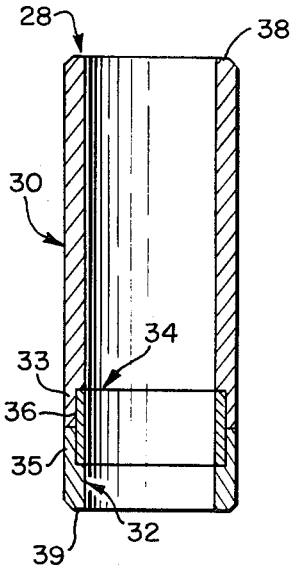
FIG. 2 shows a cross-section of a three-part valve guide insert assembly in which two parts of a sleeve form a recess in which the ring is retained.

In another embodiment of the invention a three-part valve guide sleeve assembly 28 as shown in FIG. 2 is employed in which the first part 30 is a cast iron sleeve defining the spring end 38, and the second part is a separate cast iron ring 32 defining the port end 39. The end 33 of the cast iron sleeve 30 remote from the spring end 38, of the cast iron sleeve 32 of the second part remote from the port end 39 together form an internal annular recess 36 for receiving a stellite or carbide ring 34. The adjacent ends of sleeve 30 and sleeve 32 abut and each has an internal recess which forms part of the overall recess 36 for ring 34.

Figure 3:
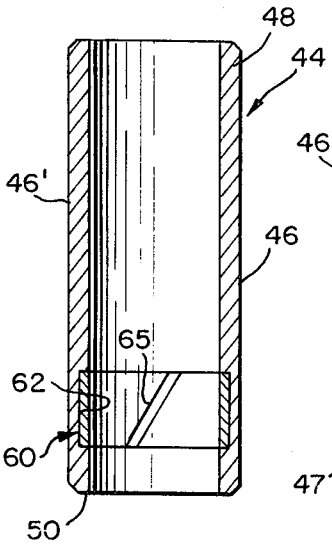
FIG. 3 is a cross-section of a three-part valve guide sleeve assembly where two parts of a sleeve form an annular recess for carrying the wear-resistant ring.
Figure 4:
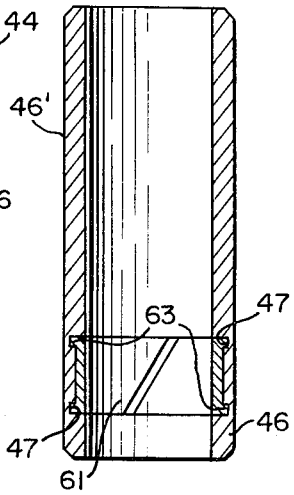
FIG. 4 shows another embodiment of the device shown in FIG. 3 where the ring has shoulders for retention of the ring within the valve guide sleeve.

In another embodiment of the invention a three-part sleeve assembly is employed in which a split two-piece, cast iron sleeve having elements 46 and 46' has a recess in the internal surfaces to carry the stellite or carbide ring. As can be seen in FIG. 3, the three-part assembly 44 includes cast iron first parts or sleeve elements 46 and 46' which together define the spring end 48, as well as the port end 50. A recess 62 is formed within the sleeve parts 46 and 46' to receive the stellite or carbide ring 60. As can be seen in FIG. 4, to enhance the retaining capability of the sleeve the additional recesses 47 can be provided near the ends of recess 62 and recesses 47 are carved more deeply into and around the internal walls of sleeve elements 46 and 46'. Similarly, ring 61 can have complementary annular shoulders 63 for extension into recesses 47. In this manner the ring 62 is even further prevented from moving out of the desired position.

Figure 8:
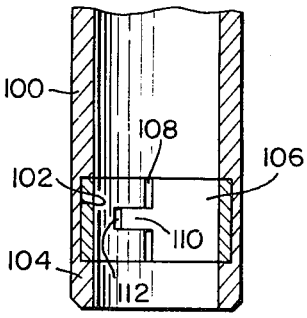
FIG. 8 is a cross-section of a partial view of a two-piece valve guide sleeve assembly where a one piece sleeve forms a recess for a split ring.

Another alternative is a two part sleeve assembly having a one-piece cast iron sleeve with a split ring as shown in FIG. 8. The one piece sleeve 100 is similar in configuration to the sleeves shown in FIGS. 3 and 4 except that it is one piece rather than being split into two separate pieces. A recess 102 is defined by sleeve 100 adjacent port end 104 to receive a split stellite or carbide ring 106. Ring 106 is split at 108 so that it can be compressed for insertion into recess 102. The ring is thus somewhat resilient and will expand into the desired position once located in the vicinity of the recess. As shown the ring includes a tongue 110 and groove 112 into which the tongue 110 extends configured to accommodate the compression required for locating the ring properly with the recess. This tongue and groove configuration eliminates a gap through the entire width of the ring which might otherwise exist and thereby substantially eliminates blowby and lubricant loss.

Figure 6:
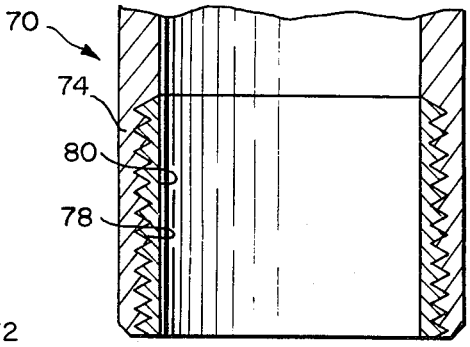
FIG. 6 is a partial view of the valve guide shown in FIG. 5 enlarged and with spray metal refinished.
Figure 5:
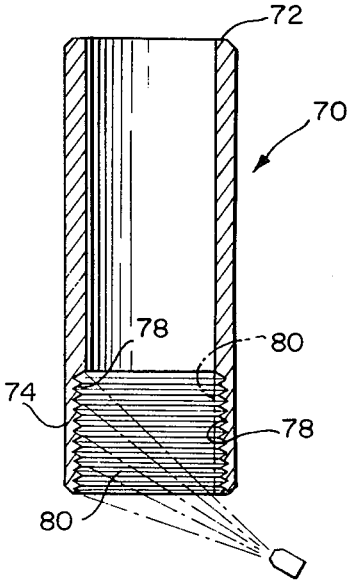
FIG. 5 is a cross-section of a single piece, valve guide sleeve assembly having a sprayed metal ring for counteracting wear.

In another embodiment of the invention shown in FIG. 5, a wear-resistant metal, e.g. an alloy containing molybdenum and cobalt, in melted form is sprayed onto the inside surface at the port end portion of the valve guide to form a single composite valve guide assembly. The cast iron sleeve 70 includes spring end 72 and a port end 74. The internal surface adjacent the port end is machined to form grooves 78 or other roughened or recessed surface over the portion of the sleeve where the wear-resistant metal is to be carried. The depth of the roughened area is sufficient for forming an adequate layer of metal whose thickness, after any subsequent machining, is sufficient to properly adhere and alleviate valve stem wear. Subsequently, as shown in the left portion of FIG. 5, the metal 80 is sprayed and thereby bonded onto the grooves (shown by phantom lines at 80) to the requisite depth to fill or slightly overfill the grooves, after which the entire internal surfaces of the assembly are refinished to a specified size to create a constant internal diameter throughout the valve guide sleeve. The one-piece sleeve with the metal 80 as refinished is shown in FIG. 6. With this system a one-piece composite system is formed which substantially prevents the protective metal from being inadvertently removed from the surface of the valve guide sleeve during the placement of sleeve in the valve guide in the engine head.

Figure 7:
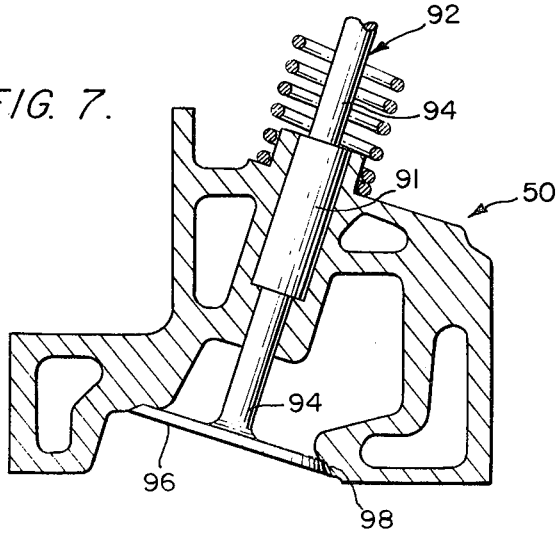
FIG. 7 is a cross-section of a partial view of a head for an internal combustion engine having a valve guide insert.

As shown in FIG. 7 a valve guide insert 91 of any one of the embodiments discussed above is located in an engine head 90 with the valve 92 in place for reciprocation during engine operation. Valve stem 94 extends entirely through the head 90 where it is exposed for actuation. As shown the valve 92 is spring loaded in a closed position such that valve head 96 is pressed against valve seat 98. In operation a standard rocker arm assembly, for example, will engage the valve stem to overcome the spring bias and force valve head 96 off the valve seat 98 to an open position where exhaust gases are expelled. Continued operation will release valve 92 so that it returns under the spring bias to a closed position. As explained above this reciprocating action of valve stem 94 is guided by insert 91 while minimizing wear.

It can readily be seen that with the above systems a device is achieved which avoids the wear of the previous valve guide assemblies without materially altering the advantageous heat transfer characteristics of the main valve guide sleeve. The structure of the invention is also relatively simple in construction.

It is claimed is:

1. A valve guide insert for lining a valve guide of an internal combustion engine comprising a metallic, tubular sleeve having a spring end and a port end, said sleeve having an outer surface adapted to fit within the valve guide of the internal combustion engine and a length of an inner surface for receiving a valve stem, a major portion of the length of the inner surface of said insert being of a metal of good heat conductivity, and a minor portion of the length of the inner surface of said insert disposed only at said port end being metal of greater wear-resistance than the metal of the remainder of said sleeve, and said minor portion comprising a material selected from the class consisting of heavy metal carbide and stellite.

2. The valve guide insert of claim 1 in which said minor portion is formed by spraying a metal selected from the class consisting of heavy metal carbide and stellite into a cut-out portion of the inner surface of said sleeve and the inner surface of said sprayed metal being refinished to provide a uniform internal diameter of said sleeve.

3. The valve guide insert according to claim 1 or 2 wherein said minor portion extends essentially entirely about the circumference of said sleeve.

4. The valve guide insert according to claim 3 wherein said minor portion has a length that is up to about 30% of the length of said sleeve.

5. A valve guide insert for lining a valve guide of an internal combustion engine comprising a metallic, tubular sleeve having a spring end and a port end, the metal of said sleeve having high thermal conductivity, said sleeve having an outer surface adapted to fit within the valve guide of the internal combustion engine and a length of an inner surface to receive a valve stem; said sleeve having a first component extending over a major portion of the length of the inner surface and a second component extending over a minor portion of the length of the inner surface, said first component being a metal of good heat conductivity, said second component of said sleeve comprising a metal ring insert consisting essentially of a material selected from the class consisting of stellite and heavy metal carbide, and said second component being positioned only in said port end.

6. A valve guide insert for lining a valve guide of an internal combustion engine comprising a tubular, metallic sleeve having a spring end and a port end, said sleeve having an outer surface adapted to fit within the valve guide of the internal combustion engine and a length of an inner surface to receive a valve stem, said sleeve including a first component extending over a major portion of the length of the inner surface and a second component extending over a minor portion of the length of the inner surface, said first component comprising a material of high thermal conductivity compared to that of said second component; said second component comprising a material of greater wear resistance than the material of said first component, said material of said second component selected from the class consisting of heavy metal carbide and stellite, said second component being disposed only in an area of wear between the center of said sleeve and said port end, said sleeve having a substantially constant inner diameter extending substantially the entire length of said sleeve.

7. The valve guide insert according to claim 5 or 6 wherein said minor portion is a separate element from said major portion.

8. The valve guide insert according to claim 7 wherein said major portion includes a first member comprising said spring end and said minor portion includes a second member comprising said port end.

9. The valve guide insert according to claim 8 wherein said first member includes an annular offset end remote from said spring end and said second member having a complementary annular extended portion for extending into said offset end.

10. The valve guide insert according to claim 9 wherein said first member consists essentially of cast iron.

11. The valve guide insert according to claim 7 wherein said major portion defines an annular recess and said minor portion is retained within said recess.

12. A valve guide insert according to claim 11 wherein said major portion includes two parts fitted together to form a split guide insert defining said spring end and said port end, and said minor portion defining a third part comprising a ring, said annular recess being located in said two parts and displaced from said port end.

13. The valve guide insert according to claim 12 wherein said ring has at least one annular flange extending radially therefrom and said recess is configured to receive said flange to retain said ring within said recess.

14. A valve guide insert according to claim 11 wherein said major portion includes a one piece sleeve defining said spring end and said port end, and said minor portion includes a resilient split ring, said annular recess being displaced from said port end and said split ring being compressible for insertion into said recess.

15. The valve guide insert according to claim 14 wherein said split ring includes a tongue, a groove for receiving said tongue to accommodate compression and expansion of said ring.

16. The valve guide insert according to claim 11 wherein said major portion includes at least two parts, a first part comprising said spring end, an end remote from said spring end defining at least a portion of said recess, a second part comprising said port end and an end remote from said port end defining the remainder of said recess with said first part; and said minor portion defining a third part configured to be retained within said recess formed by said first and second parts.

17. The valve guide insert according to claim 13 wherein said recess is displaced from said port end.

18. The valve guide insert according to claim 14 wherein said first and second parts consist essentially of cast iron.

* * * * *